United States Patent [19]

Deswarte et al.

[11] Patent Number: 4,961,332

[45] Date of Patent: Oct. 9, 1990

[54] COMBINATION DISK LOCK COMPRISING MEANS FOR AUTOMATIC SCRAMBLING ON LOCKING

[75] Inventors: Serge Deswarte, Ault-Onival; Etienne Decayeux, Feuquieres en Vimeu, both of France

[73] Assignee: Decayeux S.A., Feuquieres en Vimeu, France

[21] Appl. No.: 197,837

[22] Filed: May 24, 1988

[30] Foreign Application Priority Data

May 27, 1987 [FR] France ..... 87 07460

[51] Int. Cl.[5] ..... E05B 37/00

[52] U.S. Cl. ..... 70/303 A; 70/314

[58] Field of Search ..... 70/301, 302, 303 A, 70/303 R, 314–318, 321, 322

[56] References Cited

U.S. PATENT DOCUMENTS

| | | | |
|---|---|---|---|
| 470,110 | 3/1892 | Dorn | 70/302 |
| 1,863,537 | 6/1932 | Aster | 70/303 R |
| 2,436,859 | 3/1948 | Eras | 70/314 |
| 2,766,608 | 10/1956 | Hirn | 70/303 A |
| 3,176,486 | 4/1965 | Richardson | 70/303 A X |
| 3,339,382 | 9/1967 | Miller et al. | 70/314 X |
| 3,369,382 | 2/1968 | Russell et al. | 70/314 X |
| 3,447,348 | 6/1969 | Davenbaugh | 70/314 X |
| 3,481,167 | 2/1969 | Barner | 70/303 R |
| 4,147,045 | 4/1979 | Testa . | |
| 4,257,249 | 3/1981 | Johns-Hunt | 70/303 A |

FOREIGN PATENT DOCUMENTS

| | | | |
|---|---|---|---|
| 29818 | 7/1956 | Fed. Rep. of Germany | 70/301 |
| 24195 | of 1894 | United Kingdom | 70/301 |

*Primary Examiner*—Robert L. Wolfe
*Assistant Examiner*—Suzanne L. Dino
*Attorney, Agent, or Firm*—Stevens, Davis, Miller & Mosher

[57] ABSTRACT

A lock comprising notched combination disks, a bolt movable in translation and urged to its extended position which may be moved solely when a coded combination has been formed by rotation of the combination disks, and means for driving the bolt to its retracted position. In accordance with the invention, the lock comprises means for locking the bolt in the retracted position, means for making said bolt drive means inoperative when the bolt is in its retracted position, and means for unlocking the bolt once the door has been opened then closed again.

10 Claims, 8 Drawing Sheets

COMBINATION DISK LOCK COMPRISING MEANS FOR AUTOMATIC SCRAMBLING ON LOCKING

BACKGROUND OF THE INVENTION

The invention relates to a lock fitted to a door and comprising a bolt movable in a straight line between an extended position and a retracted position, means for urging the bolt to its extended position, means for returning the bolt from its extended position to its retracted position, movably coupled to the bolt, a combination disk, comprising a notch and stop means, mounted for rotation on a shaft, a drive disk mounted for rotation on said shaft comprising stop means cooperating with those of the combination disk in a given relative angular position of these disks, and first means for cooperating with said bolt traction means, means for rotating the drive disk, second means for cooperating with said bolt traction means, adapted so as to be received in said notch in a given angular position of the combination disk, obtained by actuating said operating means in accordance with a coded combination, these second means being movable between a position in which they are situated outside the notch and hold the bolt traction means away from the drive disk and a position in which they are situated in the notch and allow cooperation between the bolt traction means and said first means of the drive disk, the bolt then being able to be moved to its retracted position by rotation of the drive disk.

A lock of this type is known more particularly from the document US-A-4 147 045 and operates satisfactorily.

However, it reveals a few drawbacks in use.

In such a lock, the bolt is held in a retracted position by the user who immobilizes the means for operating the drive disk, for example an operating handle. Since the bolt traction means cooperate with the drive disk, they are prisoners of this latter and effectively retain the bolt in the retracted position.

At this stage, the authorized user may block the operating handle by any appropriate means for preventing subsequent closure of the lock and thus avoid having to dial the coded combination the next time he accedes to the door.

In addition, when a finger is provided for scrambling the combination disk, mounted on the bolt for striking the combination disk when the bolt is extended, the user may try to partially neutralize the scrambling effect by braking the movement of the operating handle when it returns to an angular position corresponding to closure of the door, namely by braking the movement of the bolt traction means.

SUMMARY OF THE INVENTION

The problem which the invention attempts to solve is then that of separating the operating handle from the bolt once the lock has been opened.

This problem is solved by providing in the lock means adapted for locking the bolt in its retracted position, means for moving the bolt traction means away from the drive disk when the bolt is in the retracted position, and means adapted for unlocking the bolt once the door has been opened then closed again.

Advantageously, the bolt locking means comprise a rocking lever mounted for pivoting in the bolt and returned resiliently towards the bolt, and stop means mounted on the rocking lever and adapted for cooperating with stop means provided on the bolt, and said bolt unlocking means comprise a pusher mounted for pivoting on the rocking lever and adapted for cooperating with a door casing or a mobile keeper during closure of the door so as to cause the rocking lever to pivot so as to move said stop means of the rocking lever away from the bolt.

Advantageously, said means for moving away the bolt traction means comprise a finger mounted for pivoting on the bolt, a spring mounted fixedly in the lock and adapted for cooperating with the finger when the bolt is in the retracted position, sO as to return the finger in a direction of rotation in which this latter moves said bolt traction means away from the drive disk.

Advantageously, the lock comprises an auxiliary bolt movable in a straight line between an extended position and a retracted position and means for urging it to its retracted position said drive disk being in contact with the auxiliary bolt and adapted for cooperating therewith so that, with said bolt in the retracted position, the auxiliary bolt is in its extended position if the drive disk is in an angular position in which it cooperates with said bolt traction means and the auxiliary bolt is in its retracted position in the opposite case.

Advantageously, the lock comprises scrambling means for modifying randomly the angular position of the combination disk on closure of the door, these scrambling means comprising a finger mounted on the bolt so as to be able to pivot parallel thereto and be urged towards the combination disk, said finger penetrating into said notch in the combination disk when the bolt is in the retracted position and driving the combination disk over a random angular portion when the bolt moves to its extended position.

BRIEF DESCRIPTION OF THE DRAWINGS

The following description is relative to a preferred but non limitative embodiment with reference to the accompanying drawings.

Figure 2A:
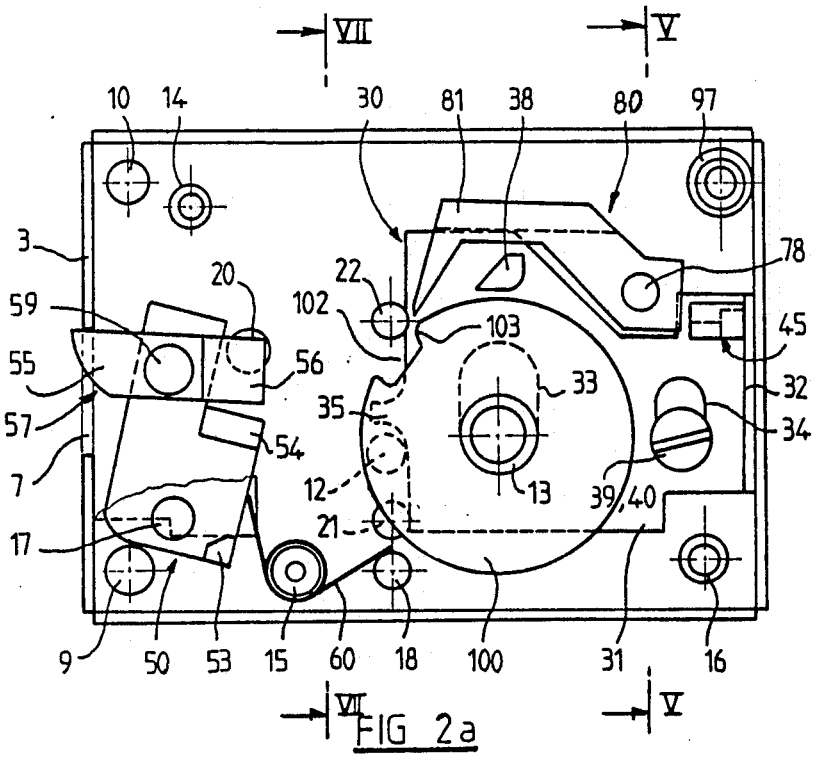
FIGS. 2*a* and 2*b* are top views of the lock in the closed position.
Figure 2B:
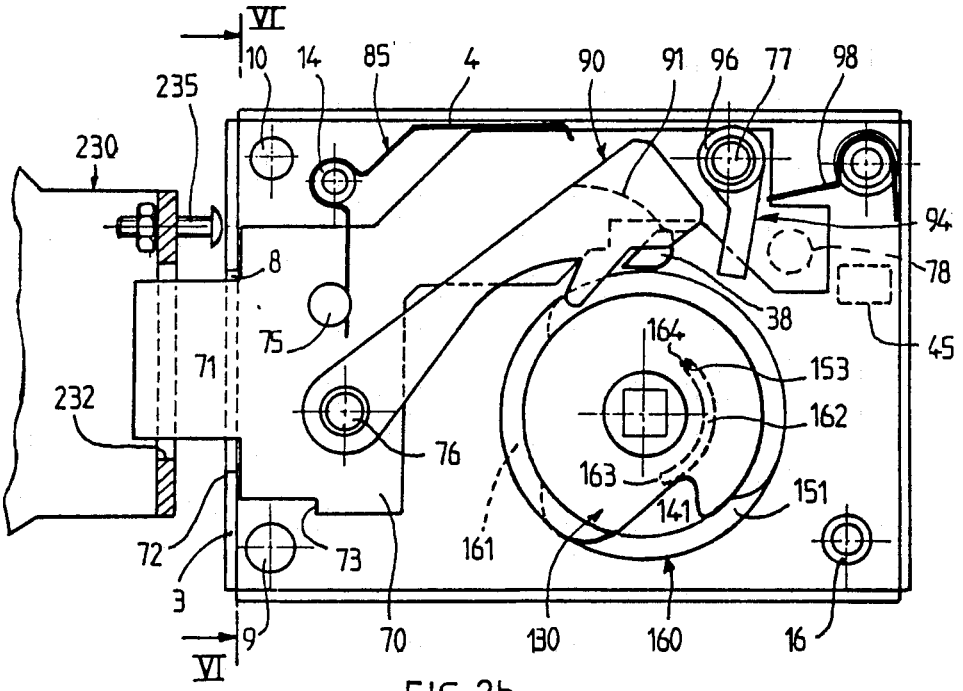
Figure 3A:
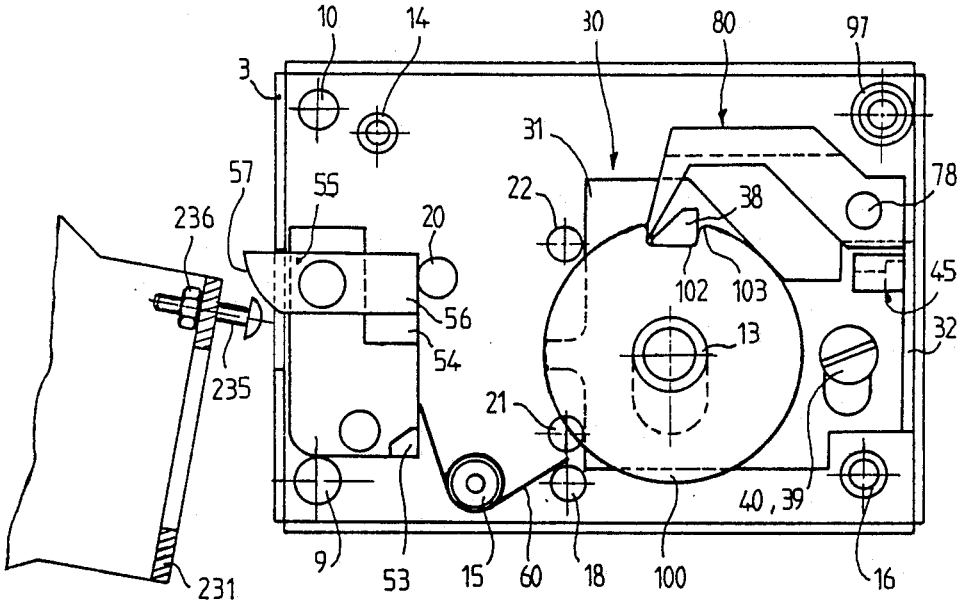
FIGS. 3*a* and 3*b* are views corresponding to FIGS. 2*a*, 2*b* when the lock is in the open position.
Figure 3B:
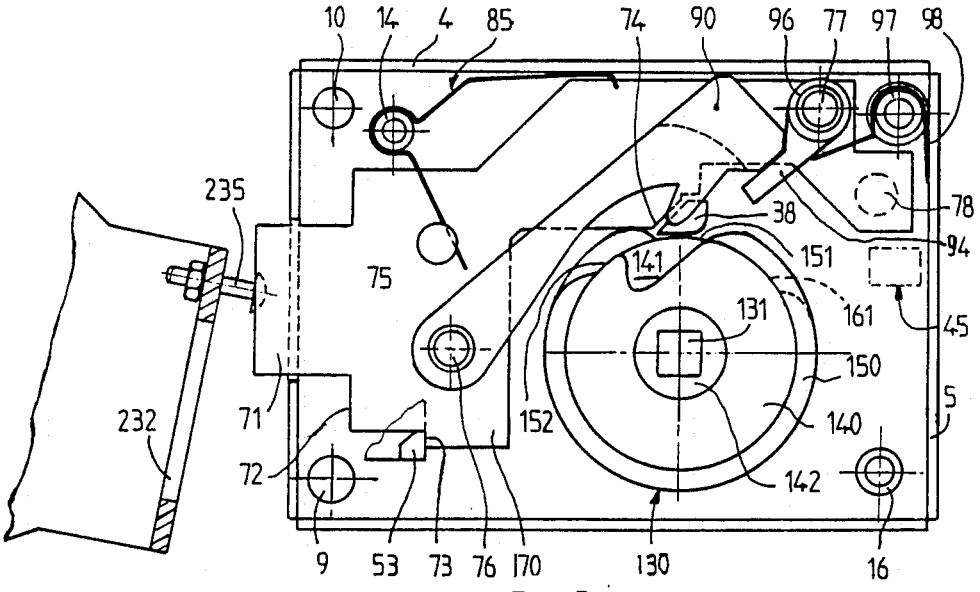
Figure 4A:
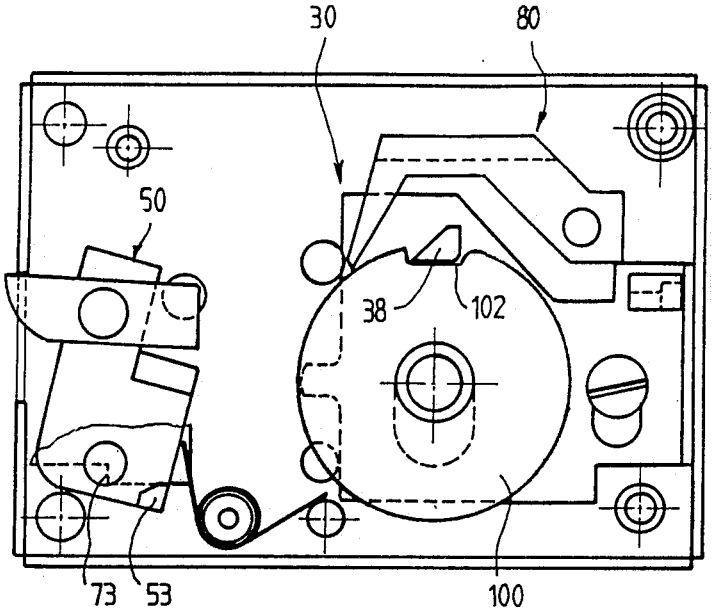
FIGS. 4*a* and 4*b* are views corresponding to FIGS. 2*a*, 2*b* when the combination allowing opening of the lock has been made.
Figure 4B:
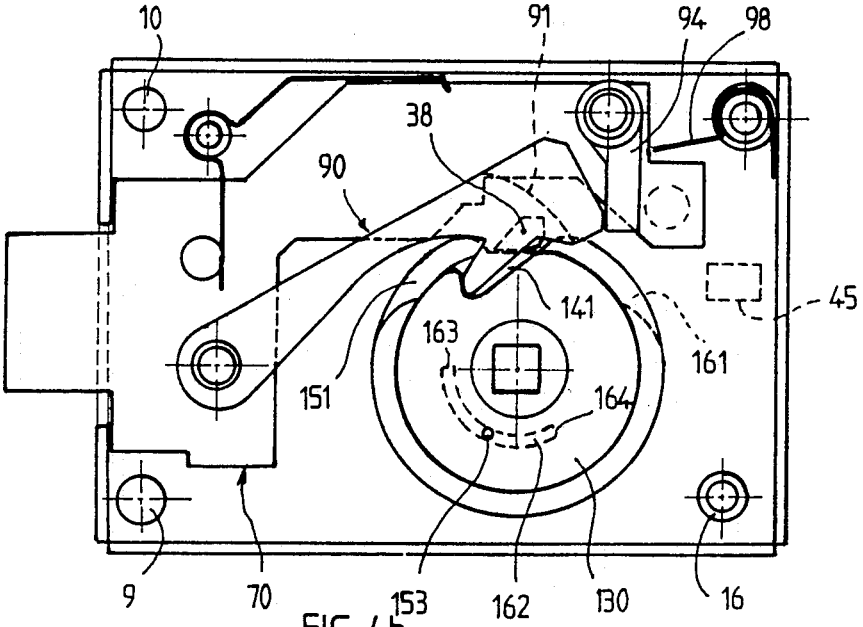
Figure 7:
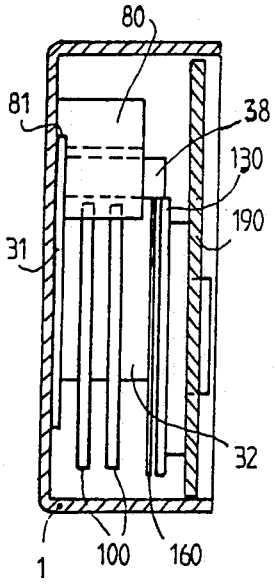
FIGS. 5 to 7 are cross sectional views through lines V—V, VI—VI, VII—VII of FIGS. 2*a* or 2*b*.
Figure 6:
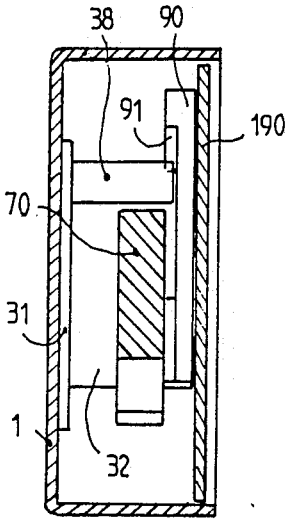

To help understanding, FIGS. 2*a*, 3*a*, 4*a* only show the bottom-most parts of the lock situated in the lock case, whereas FIGS. 2*b*, 3*b*, 4*b* only show the other more outwardly situated parts in the case of the lock.

DESCRIPTION OF THE PREFERRED EMBODIMENTS

The lock shown in the figures comprises a parallelepipedic case 1 formed of a bottom 2 and four sidewalls 3, 4, 5 , 6. As shown in the figures, the case is oriented in use so that its bottom 2 and its two opposite sidewalls 3, 5 are vertical. The vertical wall 3 comprises two rectangular apertures 7, 8 disposed at the side of each other and extending vertically.

Bottom 2 has, in three of its corners, a hole 9, 10 and 11 for fixing to a door and, in its central part, a hole 12. It further has a pluralitY of posts 13 to 19 extending perpendicularly and several studs 20 to 22, post 19 having a collar 19*a* at its base.

A reciprocating assembly 30 comprises a plate bent into an L shape so as to define two vertical faces 31, 32. Face 31 has two oblong holes 33, 34 formed side by side and extending vertically, whose dimensions are adapted for receiving respectively post 13 and the collar 19*a* of post 19 of case a finger 35 extending horizontally in the plane of face 31 from its edge opposite the other face 32, a lower notch 36 adjacent the bend of the reciprocating assembly 30 and an upper notch 37. ,Face 31 of the reciprocating assembly 30 further comprises a perpendicular finger 38 disposed above and in line with the oblong hole 33.

Figure 1A:
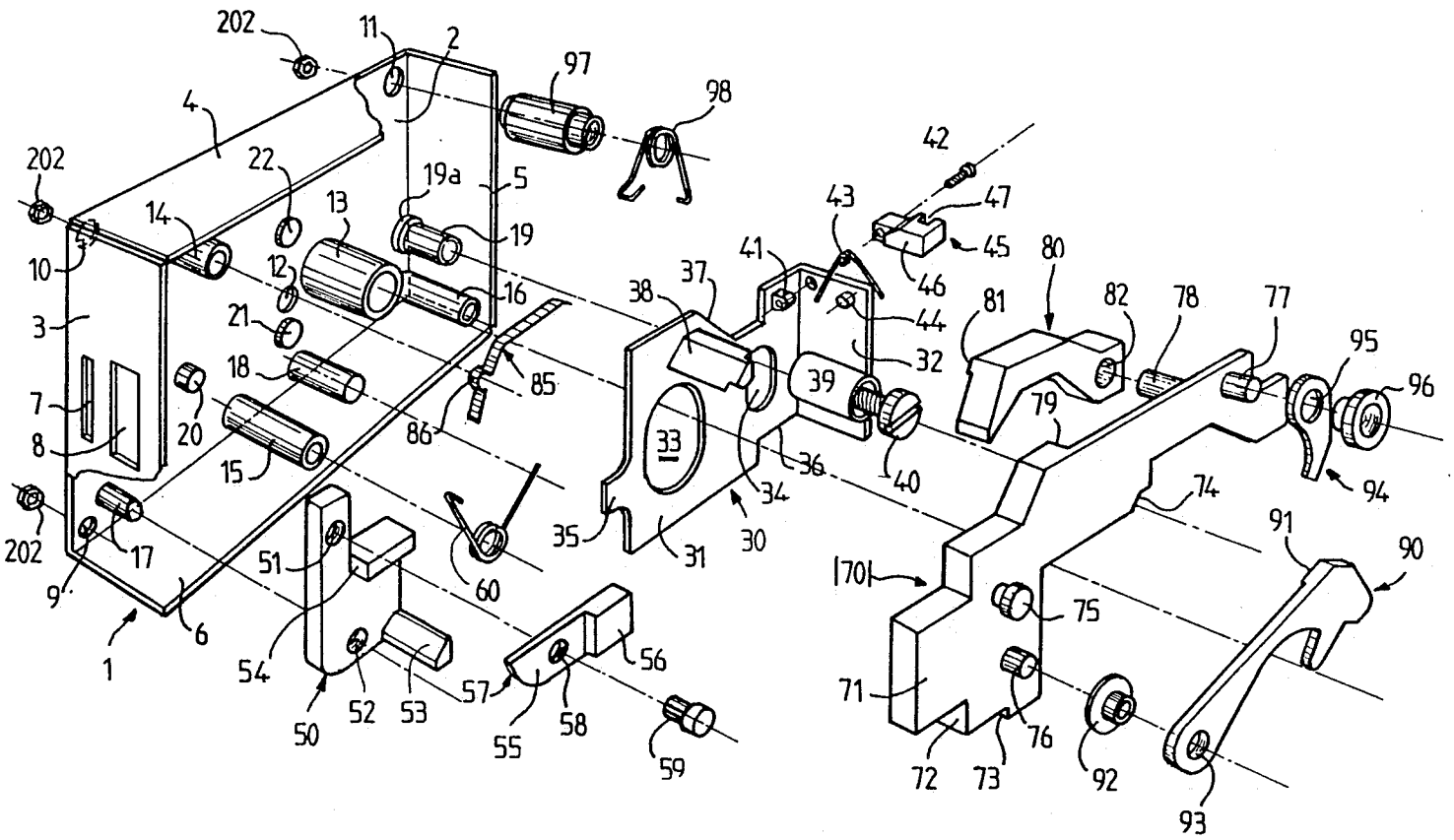
FIG. 1*a* is an exploded perspective view of a first portion of the lock.
Figure 5:
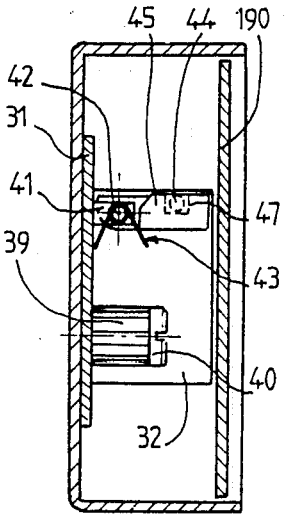

A projection 41 carried by face 31 forms, with face 32, a fork receiving a horizontal shaft 42 parallel to face 31. A mobile wedge 45 and a helical spring 43 are mounted side by side on shaft 42 (figures 1*a* and 5). Spring 43 bears by one end on face 31 and by the other end on a laterally projecting shoulder 46 provided on the mobile wedge 45.

The mobile wedge 45 has a recess 47 opening both into its upper face and its side face opposite shoulder 46, which is intended for cooperating with a stop pin 44 projecting perpendicularly from face 32. The mobile wedge 45 is therefore returned resiliently to a horizontal position in which it abuts the stop pin 44, but it may be pushed downwards so as to pivot in a clockwise direction (FIG. 5) through a certain angle at least.

The reciprocating assembly 30 is intended to be applied on the bottom 2 of case 1 by means of a spacer 39 in the form of a cylinder mounted on post 19 and whose outer diameter is greater than the oblong hole 34. Spacer 39 is fixed by screw 40 cooperating with a threaded portion of post 19. The reciprocating assembly 30 bears against the two studs 21, 22 of case 1 so that it can only make a vertical translational movement between a top position (FIG. 2*a*) and a bottom position (3*a*) in each of which one end of the oblong holes 33, 34 abuts respectively against post 13 and against the collar 19*a* of post 19.

A rocker arm 50 in the form of an L disposed in a vertical plane has two holes 51, 52, a perpendicular finger 53 disposed at the lower part of the rocking lever 50 and a perpendicular projection 54. A pusher 55 has a thickened portion 56 at one end, a rounded portion 57 turned downwardly at the opposite end and a hole 58 in a central region. A pin 59 passes through hole 58 of pusher 55 and hole 51 of the rocking lever 50. The rocking lever 50 is mounted for rotation by its hole 52 on post 17 of case 1, between a straight position (FIG. 3*a*) and an inclined position (FIG. 2*a*). It is returned resiliently to the straight position by a helical spring 60 mounted on post 15 and one end of which bears on post 18 of the case and the other end on a sidewall of the rocking lever 50. Rotation of the rocking lever 50 in a clockwise direction is limited by stud 20 against which the upper part of the rocking lever abuts its rotation in an anti-clockwise direction is limited by the sidewall 3 of case 1. The pusher passes, with its rounded end 57, through aperture 7 in all the angular positions of the rocking lever 50. It may pivot with respect to the rocking lever 50 about the pin 59. Because of the presence of its thickened portion 56, the pusher 55 tends to rotate in a clockwise direction under the effect of gravity. Its rotation in an anti-clockwise direction is only limited by the upper part of sidewall 3 of the case, against which its thickened portion 56 will abut. Its rotation in a clockwise direction is limited either by projection 54 of the rocking lever 50 against which it abuts when the rocking lever is in the vertical position (FIG. 3*a*), or by the upper edge of the aperture 7 against which it abuts when the rocking lever 50 is in the inclined position (FIG. 2*a*).

A bolt 70 with the general shape of an L on its side comprises a front parallelepipedic end 71 intended to pass through the aperture 8 in case 1 for cooperating with a bar operating device described subsequently. It has a stop face in the extended position 72 and a stop face in the retracted position 73 which are vertical and turned towards the parellelepipedic end 71 and a slanted stop face 74 turned towards its rear end which is intended to cooperate with the finger 38 of the reciprocating assembly 30.

Figure 8:
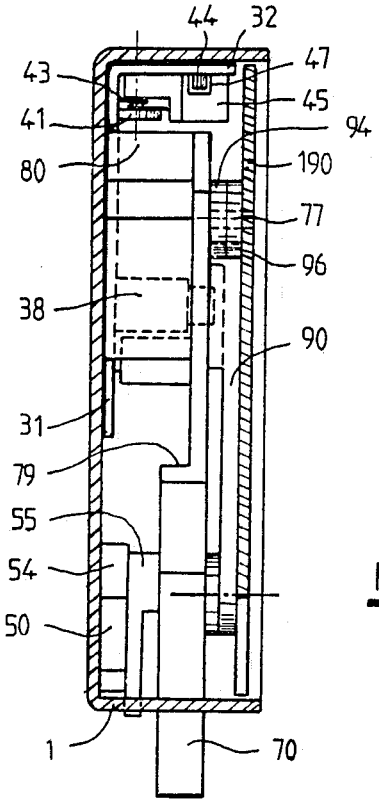
FIG. 8 is a top view showing the parts visible in FIGS. 2*a* or 2*b*.

On its main face turned outwardly of case 1, bolt 70 has two studs 75, 76 adjacent the front end 71 and a stud 77 adjacent the rear end. On its main face opposite thereto, it has a rear stud 78 disposed lower and more to the rear than stud 77 (FIG. 2*b*), and a vertical shoulder 79 which means that the rear part of bolt 71 is thinner than its front part (FIGS. 8 and 9).

A scrambling finger 80 has a hole 82 by which it is mounted for pivoting on stud 78 of bolt 70 by being rotated towards the front end 71 of the bolt. On its main face turned towards the bottom of case 1 and in its upper part, the scrambling finger 80 comprises a projecting shoulder 81 extending horizontally.

Figures 1B, 9:
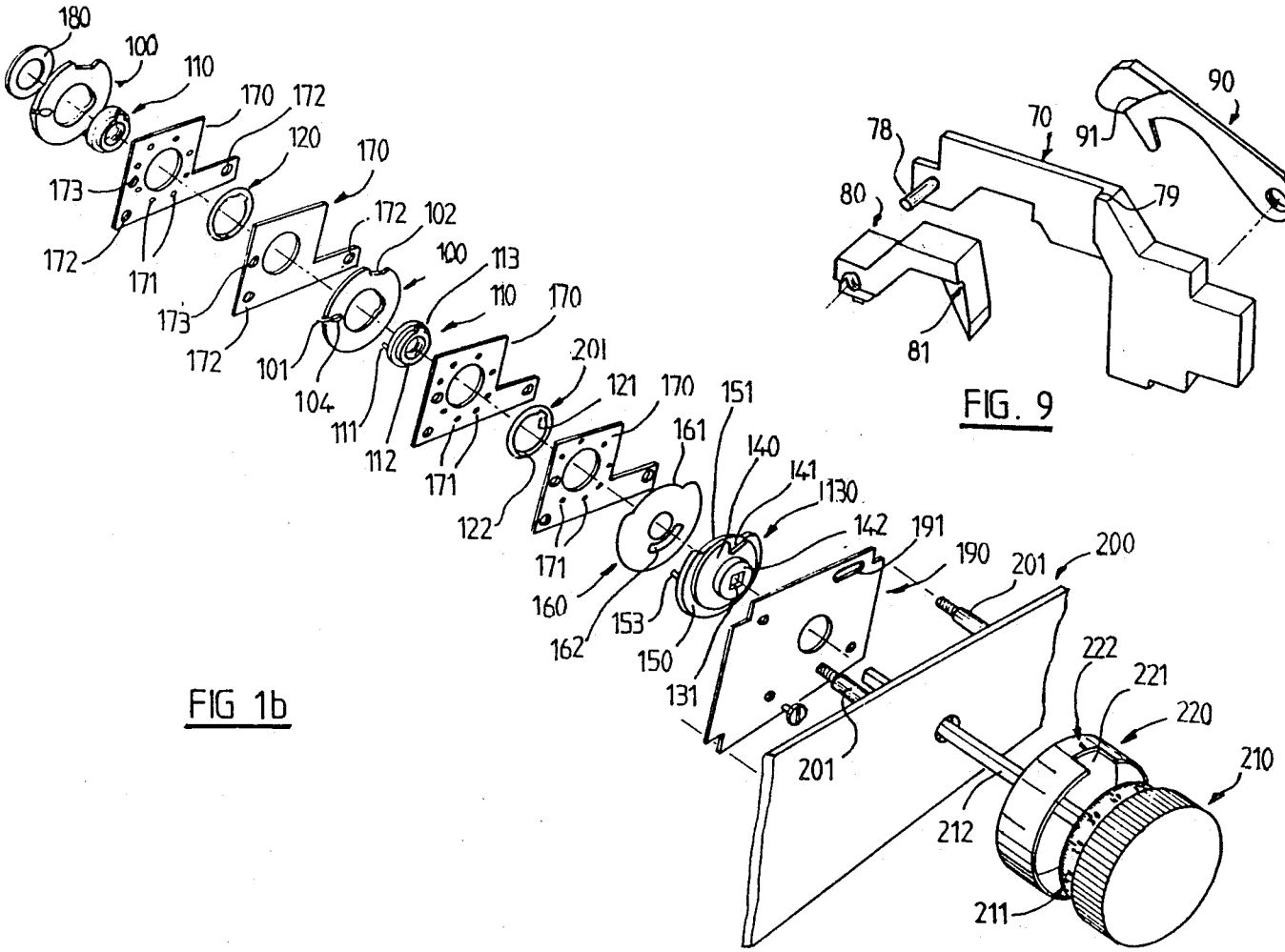
FIG. 1*b* is an exploded perspective view of a second portion of the lock.
FIG. 9 is a perspective view of the bolt of the traction hook and of the scrambler, seen from their face not visible in FIG. 1*a*.

A traction hook 90 has at one end a hole 93 and, at the opposite end, and on its main face turned towards the bottom of case 1, a projecting shoulder 91 extending along a curved line, as shown in FIGS. 4*b* and 9. This hook is mounted for pivoting on stud 76 of bolt 70, so as to be turned rearwardly of the bolt and with interpositioning of a spacing washer 92 whose thickness corresponds to that of shoulder 91 of the traction hook 90.

A disengagement finger 94 has a hole 95 by which it is mounted for pivoting on stud 77 of bolt 70. A spacing washer 96 is also mounted on stud 77 so as to cap the disengagement finger 94.

A blade spring 85 having a general V shape has two branches, one of which is deformed so as to form a gripper 86 for surrounding post 14 of case 1.

A spacing washer 97 has a re-entrant shoulder at both ends, one being received in hole 11 at the bottom of case 1 and the other receiving a helical spring 98.

Bolt 70, equipped with the scrambling finger 80, with the traction hook 90 and the disengagement finger 94 is disposed in case 1, in front of the reciprocating assembly 30 and the rocking lever 50. These parts are shown in FIG. 8, where it can be seen that the shoulder 79 of bolt 70 advantageously allows the scrambling finger 80 to be partiallY housed.

Bolt 70 may be moved in a straight line in case 1 between an extended position (FIG. 2*b*) and a retracted position (FIG. 3*b*). In these two positions, its front end 71 bears on the lower edge of the aperture 8 of case 1. Furthermore, the blade spring 85 bears by one of its branches on the sidewall 4 of the case and by the other on stud 75 of bolt 70, so that the bolt 70 is returned resiliently to its extended position. As will be mentioned hereafter, the rear part of the bolt is supported by an aperture 191 in a plate 190 covering the lock. In addition, in the retracted position of bolt 70, the helical spring 98 bears by one of its ends on the sidewall 5 of the case and by the other end on the disengagement finger 94 and tends to cause this latter to pivot in a clockwise direction.

In the extended position, bolt 70 abuts with its stop face 72 against the sidewall 3 of the case. Before the combination of the lock has been formed for opening it (FIGS. 2*a* and 2*b*) and as mentioned hereafter, the reciprocating assembly 30 is in the top position and the mobile wedge 45 which it carries is then situated behind the rear end of bolt 70 : it follows that bolt 70 cannot be pushed manually towards its retracted position for it would abut against the mobile wedge 45. On the other hand, once the combination is formed, bolt 70 may be retracted at most until it abuts with its rear end against the spacer socket 97.

In a way known per se, the lock comprises several apertured combination disks 100 (figures 1*b* and 2*a*), which are open along a radial slit 101 and which have a notch 102 on their radial outer edge; in accordance with the invention, however, one of the ends 103 of the notch is connected to the outer edge of the disk along a radius intended to cooperate with finger 38 of the reciprocating assembly 30. In line with slit 101, each combination disk has a hole 104 for moving it away by means of a key. Apertured cores 110, whose outer diameter is a little greater than the inner diameter of the combination disks, may thus be mounted by resilience therein. Each core has on one face a finger 111 parallel to the axis of the core and on the other face an annular flange 112 itself carrying a finger 113 extending radially outwardly.

In a way also known per se, the lock comprises secondary apertured drive disks 120, having on their radially inner edge a notch 121 and, opposite thereto, a finger 122 extending parallel to the axis of the disks. Furthermore, a main drive disk 130 (FIGS. 1*b* and 3*b*) is provided whose structure is specific to the present invention. It is formed of two disks 140, 150 applied permanently one against the other and having different outer diameters, the smallest diameter disk 140 having a cut-out 141 opening outwardly and towards its radially outer edge, disk 150 having a similar cut-out 151 disposed in line with the cut-out 141, and whose bottom 152 extends peripherally along an arc of a circle of a radius equal to the radius of the other disk 140. The cut-out 151 extends over an angular portion greater than that along which cut-out 141 extends. Moreover, disk 140 has a circular central thickened portion 142 and disk 150 has a finger 153 parallel to its axis. Finally, the main drive disk 130 as a whole comprises a through hole 131 of square section.

An apertured spacer disk 160 has, seen in a top view, an external shape and size identical to those of disk 150, so in particular cut-out 161. It has in addition, an aperture 162 extending along a circle portion defined by an angular sector a little greater than that along which the cut-out 151 in disk 150 extends.

Spacer plates 170, known per se, are interposed between the combination disks 100 and the secondary drive disks 120 on the one hand ,and between the spacer disk 160 and the secondary adjacent drive disk 120. Some have bosses 171 distributed peripherally for bearing on the adjacent spacer plate or on the spacer disk 160. Each spacer plate has two lower holes 172 through which pass the posts 15, 16 of case 1 and a mid-height hole 173 disposed opposite the hole 104 in the combination disks 100.

The combination disks 100, cores 110, the main 130 and secondary 120 drive disks and the spacer plates 170 are fitted on the post 13 of case 1, with previous interpositioning of a washer 180. A cover plate 190 holds all the parts of the lock applied against each other in case 1. It is held in position by screwing on to the three posts 14 to 16 of the case. It has a horizontal aperture 191 in its right hand upper part which is intended to guide and support stud 77 of bolt 70 during the translational movement thereof.

The lock as a whole is fixed to a door panel 200 by means of threaded posts 201 secured to this panel, one of them passing through the spacer socket 97, these posts cooperating with nuts 202. A control knob 210 for the lock comprises a cylindrical surface 211 graduated circumferentially and a square section rod 212 passing through the door panel 200 for cooperating with the square hole 131 in the main drive disk 130. A cylindrical housing 220 is adapted for receiving and masking the graduated portion 211 of the control knob 210. It has a notch 221 in its upper part allowing the graduated surface 211 to be observed solely by the user of the lock and positioning of the knob 210 opposite a mark 222. Housing 220 is fixed by appropriate means to the door panel 200 and the knob 210 is coupled to housing 220 by appropriate means -so as to only allow rotation of the knob with respect to the housing.

In operation, when knob 210 is rotated in a clockwise direction, it drives the main drive disk 130. At a given moment during such rotation, finger 153 of the main drive disk 130 abuts against one end 163 of the aperture 162 of the spacer disk 160 and then rotates this latter. The arrangement is such that the notches 151 and 161 in the respective disks 130, 160 then occupy the same angular position.

On the other hand, when the main drive disk 130 is rotated in an anti-clockwise direction, its finger 153 abuts against the other end 164 of aperture 162 of the spacer disk 160 and then rotates this latter (FIG. 2*b*). The arrangement is such that notches 151 and 161 of respective disks 130, 160 are then offset angularly, so that notch 151 is masked by the spacer disk 160.

Furthermore, and in a way known per se, finger 153 of the main drive disk 130 abuts against the finger 122 of the secondary drive disk 120 which begins to rotate. When notch 121 of this disk abuts, by one end, against the radial finger 113 of the adjacent core 110, this latter rotates in its turn. Similarly, the axial finger 111 of core 110 drives the adjacent secondary drive disk 120, which drives the adjacent core 110. Since the combination disks 100 are fast with the cores 110, they rotate so that the angular position of their notch 102 is modified. Also in a way known per se, for opening the lock, it is necessary first of all to position the bottom-most combination disk 100 in the case so that its notch 102 is in the top position (FIGS. 3*a* and 4*a*), for example by rotating the knob 210 in a clockwise direction. Then the second combination finger 100 is positioned by rotating the knob in an anti-clockwise direction.

Figure 10:
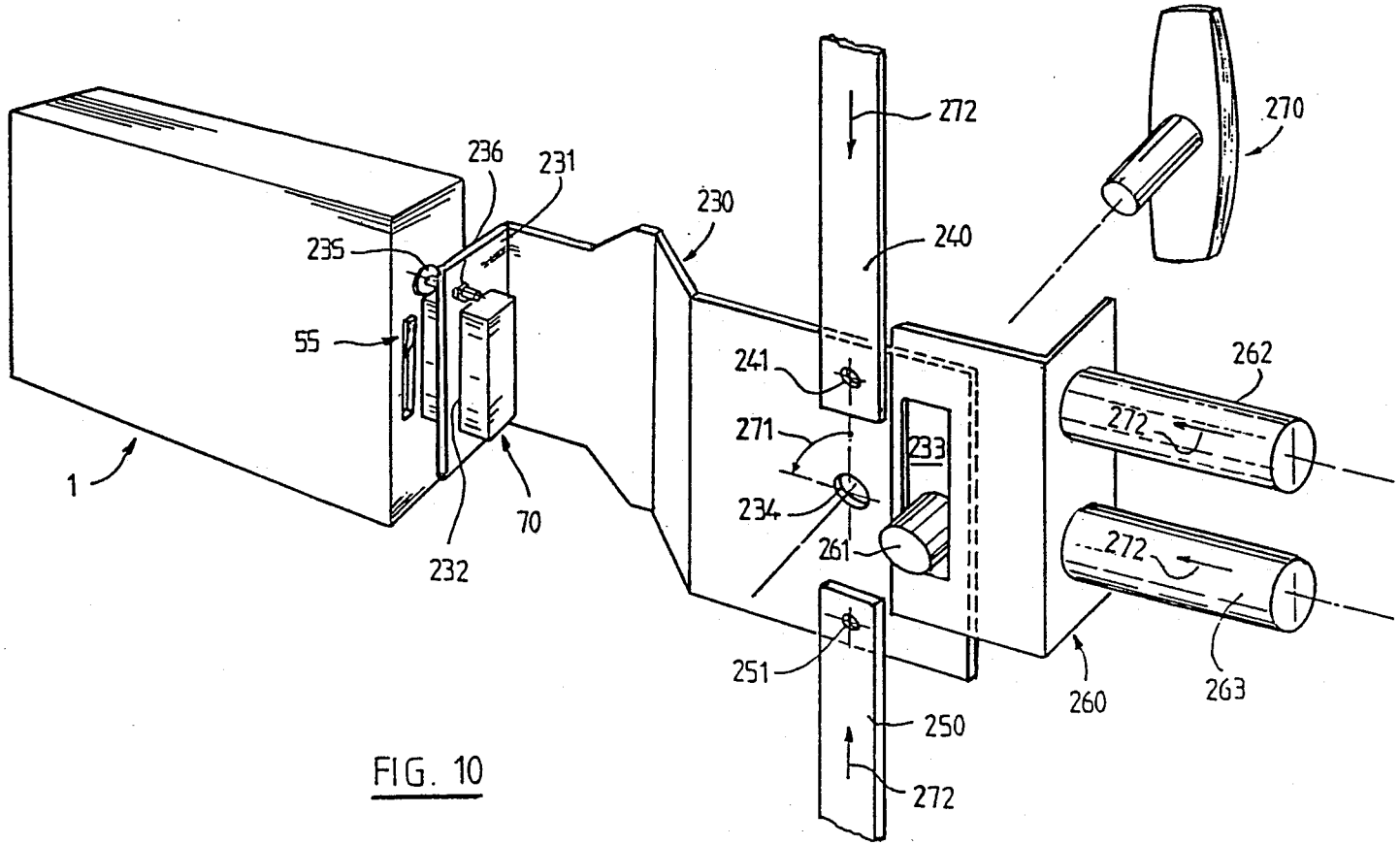
FIG. 10 is a perspective view of the lock cooperating with a door closure bar mechanism.

As is clear from FIG. 10, and in this embodiment, a mechanism for closing the door is mounted on the panel of the door, beside the case 1 of the lock. In a way known per se, this mechanism comprises a keeper 230 extending substantially in the plane of the lock, which has one L shaped end 231 with a rectangular opening 232 for receiving the end 71 of the bolt 70, and another end, also with a rectangular opening 233. This keeper is mounted for pivoting in its plane on a shaft 234.

Above and below shaft 234 two bars 240, 250 are mounted for pivoting by one end about two shafts 241, 251 and extend respectively upwards and downwards and are intended to cooperate with keepers provided in a casing of the door. A vertical bracket 260 in the form of an L has on one leg a pin 261 adapted for moving in the opening 233 of keeper 230 and on another leg two horizontal bolts 262, 263 disposed one below the other and adapted for cooperating with two corresponding keepers provided on the casing of the door.

A handle 270 is used for rotating keeper 230. In a way also known per se, rotation of handle 270 in the direction of arrow 271 (FIG. 10) allows the bars 240, 250 and bolts 262, 263 to be driven in the direction of arrows 272 so as to move them away from the keepers with which they cooperate, and rotation of the handle in the opposite direction results in causing them to penetrate into the keepers.

According to the invention, the L shaped end 231 of keeper 230 has a perpendicular screw 235 projecting outwardly which is immobilized by a nut 236.

The operation of the lock as a whole will now be described. It will be considered that the lock is closed (FIGS. 2*a*, 2*b*). Bolt 70 is in the extended position, in which it penetrates into opening 232 in keeper 230. The disengagement finger 94 hangs under the effect of its own weight, for spring 98 does not cooperate with it. The relative position of the drive disk 130 and of the spacer disk 160 then depends on the direction of rotation in which knob 210 was last rotated. Such as shown in FIG. 2*b*, it has been considered that the knob has been rotated in an anti-clockwise direction, so that the two disks 130, 160 are offset angularly and the finger .38 of the reciprocating assembly 30 may then either bear on both of them, as shown in FIG. 2*b*, or bear on disk 160 alone if the knob is rotated through about 180° in an anti-clockwise direction and if notch 151 faces the finger 38 of the reciprocating assembly 30. In both cases, finger 38 is supported at the same height so as to be situated a little above the combination disks 100 (FIG. 2*a*). With this arrangement, it is not possible to attempt to discover the coded combination of the lock by rotating knob 210: in known locks, where finger 38 rested on the combination disks, it was possible to hear the impact of finger 38 rubbing against one or other of the notches 102 of these disks.

The reciprocating assembly is therefore in the top position so that the mobile wedge 45 is situated behind the bolt 70, preventing this latter from being pushed inwardly of the lock. The scrambling finger 80 rests by its shoulder 81 on the face 31 of the reciprocating assembly 30. The combination disks 100 are in a random angular position.

The traction hook 90 rests by its shoulder 91 on finger 38 of the reciprocating assembly 30 and is therefore held in a top position not allowing it to penetrate into the notch 141 in the drive disk 130.

Finally, the rocking lever 50 bears by its finger 53 under bolt 70 (FIG. 2*a*) and is therefore held in a slanted position so that pusher 55 is almost completely retracted into the lock and is not in contact with the screw 235 carried by the keeper 230.

We will now consider that the coded combination has been made by rotating knob 210 (FIGS. 4*a* and 4*b*) in one direction and in the other alternately, and for the last time in an anti-clockwise direction. Notches 102 of the two combination disks 100 are therefore aligned in the top position. Knob 210 was then rotated in a clockwise direction so that notch 151 is progressively no longer masked by the spacer disk 160, and so that the finger 38 on the reciprocating assembly 30 falls on the bottom 152 of notch 151 whose radial distance is identical to that of the bottom of notches 102 in the combination disks 100 in FIG. 4*a*, finger 38 is therefore at the bottom of notches 102.

Consequently, the traction hook 90 has pivoted under the effect of gravity until it abuts against the bottom of notch 141 of the main drive disk 130 : it will in fact be noted that, in FIG. 4*b*, the traction hook 90 is no longer supported by the finger 38 of the reciprocating assembly 30.

Another consequence is that the reciprocating assembly 30 has moved to its low position. The scrambling finger 80 is therefore no longer supported by the reciprocating assembly 30 and bears on the combination disks 100. Furthermore, the mobile wedge 45 has moved to its low position in which it no longer prevents retraction of bolt 70.

Such as shown in FIGS. 4*a*, 4*b*, the lock is ready to be opened. It is sufficient to continue rotating knob 210 in a clockwise direction so as to drive the traction hook 90 towards the right and so cause retraction of bolt 70. The progressive retraction of bolt 70 has three successive effects : firstly the scrambling finger 80 moves back, its free end sliding over the combination disks 100 until it falls into the notch 102 thereof secondly, finger 53 of the rocking lever 50 "falls" in the shoulder of bolt 70 defined by the stop face 73 since this finger rubs against the bolt while being resiliently urged to rotate anti-clockwise finally, since the traction hook moves rightwards (FIG. 4*b*), it pushes the disengagement finger 94 against the effect of spring 98.

At the moment when the user releases knob 210, spring 98 causes the disengagement finger 94 to pivot in a clockwise direction, the disengagement finger itself causing the traction hook 90 to pivot in an anti-clockwise direction so that this latter leaves the notch 141 of the main drive disk 130 and comes against the sidewall 4 of the lock case 1.

The situation then obtained is illustrated in FIGS. 3*a*, 3*b*. The bolt is held in the retracted position by the finger 53 of the rocking lever 50. It will be noted that knob 210 can then only be rotated through an angular portion corresponding to that over which notch 151 of the main drive disk extends. In fact, in one direction as in the other, the edges of notch 151 tend to raise finger 38 now, this latter cannot be raised for it abuts against the slanting stop face 74 of bolt 70. This prevents an attempt by the user to lift finger 38 so as to lift the scrambling finger 80 and avoid scrambling of the combination disks 100.

Once the lock is opened, the keeper 230 may be rotated in a clockwise direction (FIGS. 3*a*, 3*b*) from a horizontal position (FIG. 10) by means of the handle 270. In fact, the bolt 70 no longer passes through opening 232 in keeper 230 and the screw 235 of the keeper abuts, during rotation, against pusher 55 which retracts while pivoting in an anti-clockwise direction. The door is then open.

To close the door again, handle 270 is rotated and so is keeper 230 in an anticlockwise direction. Screw 235 comes into abutment against the rounded end 57 of pusher 55. Now, this latter cannot pivot in a clockwise direction since it bears against the projection 54 of the rocking lever 50, so that the rocking lever is pushed in a clockwise direction against the effect of spring 60. The result is that the finger 53 of the rocking lever 50 is released from the stop face 73 of bolt 70 : the bolt is then pushed instananeously towards its extended position by the blade spring 85.

During extension of bolt 70, the scrambling finger 80 is driven leftwards in FIG. 3*a*, so that it pushes the combination disks 100 which rotate randomly through a certain angle. In practice, it has been observed that the different combination disks did not exactly cover the same path, so that their notches 102 are no longer aligned.

Since the combination disks 100 are rotated anti-clockwise, through the rounded end 103 of the notch 102 they push the finger 38 of the reciprocating assembly 30 back to its top position. Furthermore, with the traction hook 90 moving away from the disengagement finger 94, it is no longer supported thereby and comes into abutment against finger 38 of the reciprocating assembly 30.

The situation then obtained is the initial situation illustrated in FIGS. 2*a*, 2*b*.

In this embodiment, it has been ascertained that extension of bolt 70 takes place more slowly than rising of the reciprocating assembly 30. That means that the mobile wedge 45 abuts against the rear part of bolt 70 during rising of the reciprocating assembly 30. But since this wedge is mounted for pivoting, the mechanism of the lock is not locked, the mobile wedge 45 being pushed back downwards through a certain angle.

It will be noted that, in the absence of the disengagement finger 94, the traction hook 90 would remain in the notch 141 of the drive disk 130 after the lock has been opened, which would allow the user, by immobilizing knob 210, to prevent the automatic extension of bolt 70 when closing the door. The result would be that the lock would not be closed and the combination disks 100 would not be scrambled. In fact, it is therefore preferable to provide a disengagement finger 94.

In a way known per se, modification of a coded combination of the lock is achieved by introducing through the rear of the lock a key or rod passing through the hole 12 in case 1, holes 104 in the combination disks 100 and holes 173 in the spacer plates 170. The combination disks are then moved aside and their cores 110 may be rotated by operating knob 210. Finger 35 of the reciprocating assembly 30 advantageously rests on the key during this operation since it is situated in line with hole 12 in case 1 (FIG. 2*a*) : the reciprocating assembly 30 is therefore held in the top position, so that the traction hook 90 is moved away from the drive disk 130 which may rotate freely.

In another embodiment of the invention, no door closure mechanism is provided at the side of the lock so that the bolt of the lock cooperates directly with the fixed keeper of a door casing, the knob serving as handle for opening the door. In this case, the means for unlocking the bolt in the retracted position, for example a pusher, are adapted for cooperating with the fixed keeper.

Figure 11:
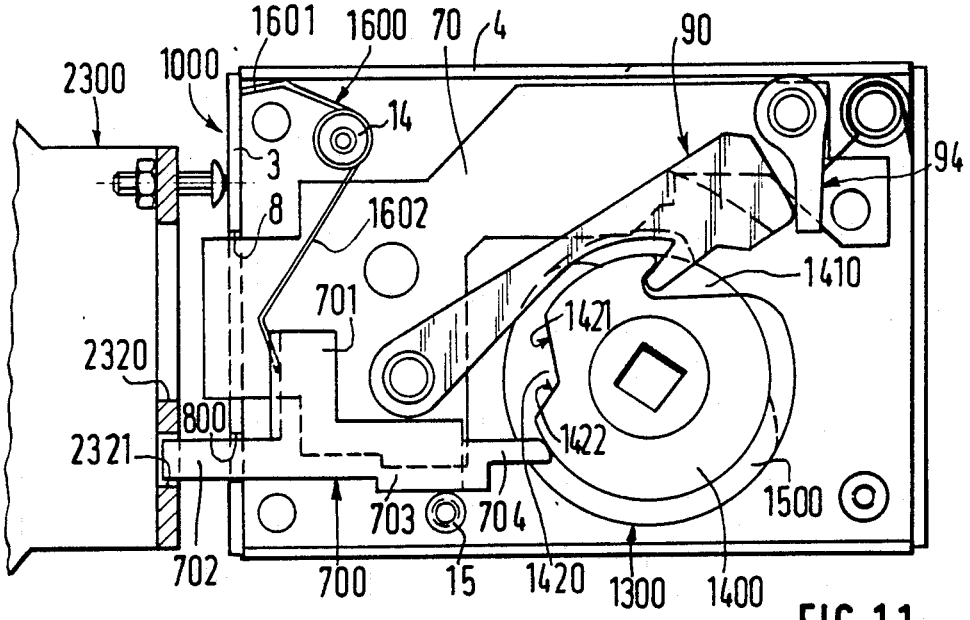
FIGS. 11 and 12 are top views of a variant of the lock, in two different operating positions.
Figure 13:
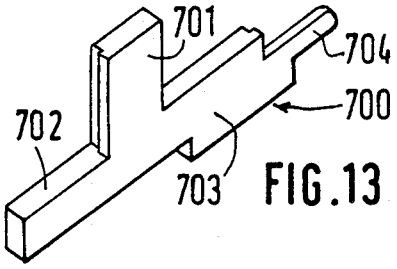
FIG. 13 is a perspective view of an auxiliary bolt used in this variant.

The above described lock operates satisfactorily. However, it may be discovered that after opening the lock, the traction hook 90 can only be withdrawn from the main drive disk 130 if the user has previously released knob 210. FIG. 11, showing a lock modification including all the elements of the first lock, and in which the unchanged elements bear the same references as in the first lock, illustrates the state of the lock after opening but before the user has released knob 210 (figure 1*b*).

In this situation, the traction hook 90 is held prisoner in notch 1410 of the main drive disk 1300. Thus, although the disengagement finger 94 bears on the traction hook 90, it cannot cause it to pivot in an anti-clockwise direction. This is what allows the user to prevent the automatic extension of bolt 70 during closure of the door and thus prevent closure of the lock and scrambling of the combination disks.

Figure 12:
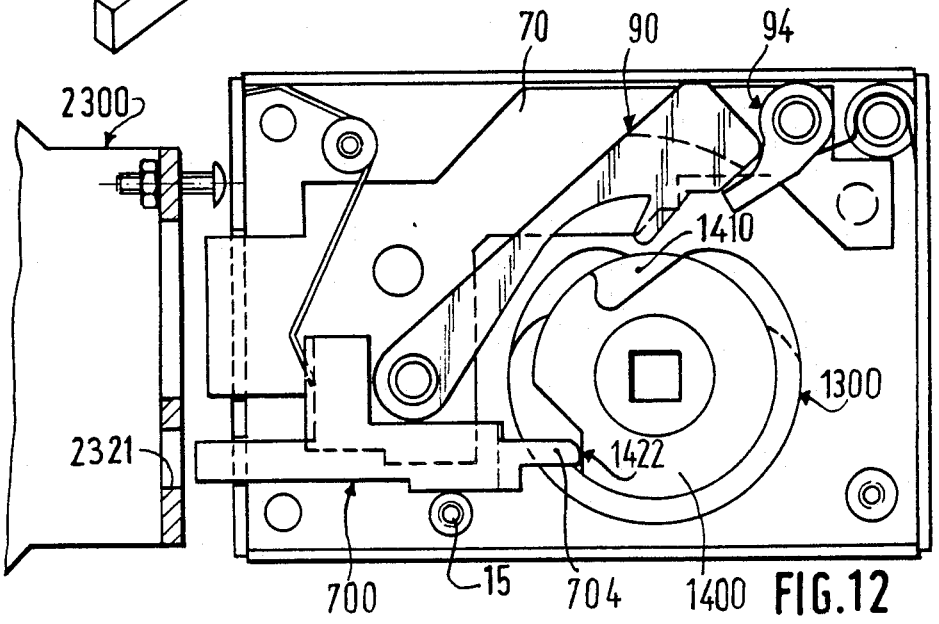

The lock shown in FIGS. 11 and 12 is adapted for forcing the user to release the knob 210 before the door can be opened. The main drive disk 1300 comprises, like that 130 of the preceding lock, two disks applied side by side 1400, 1500 and it differs therefrom in that its disk 1400 comprises a second V shaped notch 1420, defined by two faces 1421, 1422. An auxiliary bolt 700 is provided in the form of a T comprising a leg 701 and two arms 702, 703, one cf which 703 is extended by a finger 704 of smaller width, rounded at its end.

The auxiliary bolt 700 is mounted in the lock, against the face of bolt 70 turned outwardlY of the lock. Its arm 702 passes through an aperture 800 formed in case 1000, below aperture 8. Its arm 703 is guided between the base of the traction hook 90 and post 15. Its leg 701, turned towards the sidewall of case 1000 extends between the sidewall 3 and the base of the traction hook 90. Thus, the auxiliary bolt 700 may slide in a direction parallel to the sliding direction of bolt 70.

A helical spring 1600 is mounted on post 14 and comprises two legs 1601, 1602 one of which bears on the sidewall 4 of case 1000 and the other on a side face of leg 701 of the auxiliary bolt 700, turned towards the sidewall 3 of case 1000, so that the auxiliary bolt is urged to a retracted position. Thus, finger 704 of the auxiliary bolt bears against the side face of disk 1400. In the situation shown in FIG. 11 where the user has not released knob 210 (figure 1*b*), finger 704 bears on the unnotched portion of the side surface of disk 1400, so that arm 702 of the auxiliary bolt 700 extends outwardly of case 1000 beyond bolt 70, until it passes through an aperture 2321 formed in keeper 2300, below aperture 2320 intended to receive the bolt 70. Under these conditions, the user cannot open the door.

On the contrary, in FIG. 12, the user has released knob 210 so that the traction hook 90 has come out of notch 1410 : the lock is in a condition similar to that shown in FIG. 3*b*. It is now notch 1420 of disk 1400 which faces the finger 704 of the auxiliary bolt 700. The auxiliary bolt 700 thus released allows it to slide to a retracted position in which it bears against face 1422 of notch 1420 and where it no longer cooperates with keeper 2300 : the user can then open the door.

What is claimed is:

1. A lock mounted on a door and comprising a bolt movable in a straight line between an extended position and a retracted position;

means for urging the bolt to its extended position;

means for pulling the bolt from its extended position to its retracted position, movably coupled to the bolt;

a combination disk comprising a notch and stop means, mounted for rotation on a shaft;

a drive disk mounted for rotation on said shaft, comprising stop means cooperating with those of the combination disk in a given relative angular position of these disks, and first means for cooperating with said traction means of the bolt;

means for rotating the drive disk;

second means for cooperating with said traction means of the bolt, adapted so as to be received in said notch in a given angular position of the combination disk obtained by actuating operating means in accordance with a coded combination, these second means being movable between a position in which they are situated outside the notch and hold the traction means of the bolt away from the drive disk and a position in which they are situated in the notch and allow cooperation between the traction means of the bolt and said first means of the drive disk, the bolt being then movable to its retracted position by rotation of the drive disk, which lock further comprises:

means adapted for locking the bolt in its retracted position, which comprise said bolt defining a stop means and a rocking lever mounted for pivoting in the lock and urged resiliently towards the bolt and stop means mounted on the rocking lever and adapted for cooperating with said stop means provided on the bolt;

means for moving said traction means of the bolt away from the drive disk when the bolt is in its retracted position;

means adapted for unlocking the bolt once the door has been opened then closed again, by cooperating with a door casing or a mobile keeper during closure of the door so as to cause the rocking lever to pivot and said stop means of the rocking lever to be moved away from the bolt; and a door closure mechanism mounted on the door at the side of the bolt, this mechanism comprising a bar system cooperating with a casing of the door and means for operating this bar system which comprise said keeper mounted for moving in front of the bolt, the bolt passing through said keeper in its extended position so as to lock said bar system operating means, said means for unlocking the bolt being adapted for cooperating with said keeper when this latter moves at the time of closing the door for unlocking the bolt.

2. The lock as claimed in claim 1, wherein said unlocking means for the bolt comprise a pusher mounted for pivoting on the rocking lever.

3. The lock as claimed in claim 1, wherein said means for moving the traction means of the bolt away comprise:

a finger mounted for pivoting on the bolt;

a spring mounted fixedly in the lock and adapted for cooperating with the finger when the bolt is in the retracted position, so as to urge the finger in a direction of rotation in which it moves said traction means of the bolt away from the drive disk.

4. The lock as claimed in claim 3, which comprises:

an auxiliary bolt movable in translation between an extended position and a retracted position, and means for urging this later to its retracted position;

said drive disk being in contact with the auxiliary bolt and adapted for cooperating therewith so that, with the bolt in the retracted position, the auxiliary bolt is in its extended position if the drive disk is in an angular position in which it cooperates with said bolt traction means, and the auxiliary bolt is in its retracted position in the opposite case.

5. The lock as claimed in claim 1, which comprises scrambling means for randomly modifying the angular position of the combination disks during closure of the door.

6. The lock as claimed in claim 5, wherein said scrambling means comprise a finger mounted on the bolt so as to be able to pivot parallel thereto and to be urged towards the combination disk, said finger penetrating into said notch of the combination disk when the bolt is in a retracted position, and driving the combination disk over a random angular portion when the bolt moves to its extended position.

7. The lock as claimed in claim 6, which comprises means for locking the bolt in the extended position as long as the combination disk has not been brought into said given angular position.

8. The lock as claimed in claim 1, wherein the drive disk is adapted for supporting said second means which cooperate with the traction means when the bolt is in the extended position, except over a given angular sector of the disk in which it has a notch, a spacer disk having an external shape identical to that of the drive disk being mounted for rotation at the side thereof on said shaft, the spacer disk having an aperture extending over a circle portion defined by an angular sector at least equal to the preceding one, said stop means of the drive disk passing through said aperture so that, during rotation of the drive disk in the direction opposite to that corresponding to retraction of the bolt, the spacer disk masks its notch so as to support said second means in line with the notch.

9. The lock as claimed in claim 7, which comprises a reciprocating assembly on which said second means are fixed for cooperating with the traction means of the bolt and said locking means of the bolt in the extended position, said reciprocating assembly being mounted in the lock so as to be able to move in translation between a first position in which:

said second means cooperate with the traction means of the bolt;

said locking means provide locking of the bolt; and the reciprocating assembly maintains the scrambling finger away from the combination disk; and a second position in which:

said second means do not cooperate with the traction means of the bolt;

said locking means do not provide locking of the bolt; and the reciprocating assembly does not cooperate with the scrambling finger.

10. The lock as claimed in claim 1, which comprises:

several combination disks mounted for rotation on said shaft, each comprising a notch adapted for receiving said second means cooperating with the bolt traction means, and stop means on each of its faces;

several secondary drive disks, each being interposed between two combination disks or between a combination disk and the drive disk for the bolt and comprising stop means capable of cooperating with those of the adjacent disks.

* * * * *